US006149504A

United States Patent [19]

Ohmori et al.

[11] Patent Number: 6,149,504

[45] Date of Patent: Nov. 21, 2000

[54] METHOD AND APPARATUS FOR PROFILE MIRROR SURFACE GRINDING

[75] Inventors: Hitoshi Ohmori, Wako; Naoki Arai, Kawaguchi; Kiyotaka Noguchi, Kawaguchi; Takahisa Deguchi, Kawaguchi; Tamotsu Toeda, Kawaguchi; Hiroyuki Oguma, Kawaguchi; Hisayoshi Shindo, Kawaguchi; Yutaka Nagai, Kawaguchi, all of Japan

[73] Assignee: The Institute of Physical and Chemical Research, Saitama, Japan

[21] Appl. No.: 09/258,135

[22] Filed: Feb. 26, 1999

[30] Foreign Application Priority Data

Feb. 26, 1998 [JP] Japan ..... 10-045434

[51] Int. Cl.[7] ..... B24B 49/00

[52] U.S. Cl. ..... 451/56; 451/5; 451/36; 451/72; 451/443

[58] Field of Search ..... 451/56, 41, 72, 451/28, 5, 21, 36; 125/11.01, 11.02; 219/69.11

[56] References Cited

U.S. PATENT DOCUMENTS 5,547,414 8/1996 Ohmori ..... 451/21
5,660,579 8/1997 Nakayama et al. ..... 451/21
5,683,290 11/1997 Kanda et al. .
5,868,607 2/1999 Enomoto et al. ..... 451/56
5,910,040 6/1999 Moriyasu et al. ..... 451/5

FOREIGN PATENT DOCUMENTS 0 790 101 8/1997 European Pat. Off. .

OTHER PUBLICATIONS

Patent Abstracts of Japan, vol. 013, No. 025 (M–787), Jan. 20, 1989 & JP 63 237868 A (Hitachi Ltd.), Oct. 4, 1988.

*Primary Examiner*—David A. Scherbel
*Assistant Examiner*—George Nguyen
*Attorney, Agent, or Firm*—Griffin & Szipl, P.C.

[57] ABSTRACT

(A) Applying a voltage between an electrically conductive grindstone (1) and a shaping electrode (4) for shaping the grindstone, generating a spark on a contact point by contacting the shaping electrode to the grindstone, thereby shaping the grindstone by the spark, and (B) simultaneously applying a voltage between the grindstone and a dressing electrode (2) for dressing the grindstone that is oppositely aligned to the grindstone without contact, supplying the electrically conductive grinding fluid between them, thereby dressing the grindstone by electrolytic dressing. According to these steps, highly efficient and simultaneous processing is achieved to provide a high precision profiling high quality mirror.

5 Claims, 3 Drawing Sheets

METHOD AND APPARATUS FOR PROFILE MIRROR SURFACE GRINDING

BACKGROUND OF THE INVENTION

1. Technical Field of the Invention

The present invention relates to a method and an apparatus for profile mirror surface grinding simultaneously capable of highly precise profiling process and high quality mirror surface grinding of an ultra-hard material with a high efficiency.

2. Description of the Related Art

A stamping tool with complexity and high precision is essentially required for manufacturing some parts, for example a lead frame of a semiconductor in which an integrated circuit is installed, with similar complexity and high precision. Such a stamping tool should be made by profile grinding of an ultra-hard material. Thus, profile grinding processes are required to be carried out to make not only highly precise profiling, but also highly efficient grinding for mirrors to produce a high quality surface that determines a performance (sharpness, life, etc.) as a stamping tool. However, in the conventional grinding art, it is difficult to realize both shaping with high precision and mirror surface grinding of high quality simultaneously with high efficiency.

So far, a metal bond grindstone with high holding strength has been used for complicated profile grinding processes. In such processes, shaping can be done with high precision, although grinding cannot be done to produce a high quality mirror. Therefore, profiling and grinding processes should be done separately from each other. On the other hand, a thin, sharp grindstone to shape a stamping tool with a pattern of such a narrow width as a lead frame should be shaped in consideration of a change of precision caused by deformation of the grindstone. Therefore, mechanical truing is very difficult to apply.

In other words, the following are problems that arise in the background of separate processes for profile mirror surface grinding in the conventional art: (1) the shape of the grindstone used for complicated profiling processes does not allow shaping in high precision again after wearing-out, because the tip (processing part) of the grindstone is sharply pointed and can be easily blunted by wearing-out; (2) reshaping after wearing-out of the tip part does not maintain the sharpness of the grindstone in the profiling process because of the difficulty of dressing the grindstone.

On the other hand, an electrolytic in-process dressing grinding method (hereafter, ELID grinding method) as a grinding means to realize highly efficient, ultra-precise mirror surface grinding impossible with the conventional shaping art has been developed and published by the present applicants. In the ELID grinding method, the electrically conductive bonding part of a metal bond grindstone is dissolved by electrolytic dressing. An efficient mirror surface grinding for an ultra-hard material is made possible by the grinding method using a metal bond grindstone containing fine grains. Particularly, it is very valuable that the ELID grinding process with dressing means for the metal bond grindstone allows highly efficient and ultra-precise processing.

However, a thin grindstone having a sharply-shaped tip is required for the profiling process of the stamping tool particularly for a narrow width pattern such as a lead frame. Therefore, although applying the ELID grinding method allows a highly efficiently and ultra-precisely processed mirror, the following problem occurs: keeping the shape of tip is very difficult and highly precise shaping is also difficult, because the sharply pointed tip (processed part) of the grindstone is intensively subjected to electrolytic dressing.

Therefore, it is desired to add a shaping function of the metal bond grindstone to the ELID grinding process for realizing both highly precise shaping and high quality grinding with high efficiency.

SUMMARY OF THE INVENTION

The present invention has been created to satisfy such an objective. The purpose of the invention is to provide a method and an apparatus for profile mirror surface grinding allowing highly efficient and simultaneous processing of highly precise shaping and high quality mirror surface grinding.

The method for profile mirror surface grinding provided by the present invention is characterized by: (A) Applying a voltage between an electrically conductive grindstone (1) and a shaping electrode (4) for shaping the grindstone, generating a spark at a contact point by contacting the shaping electrode to the grindstone, thereby shaping the grindstone by the spark, and (B) simultaneously applying a voltage between the grindstone and a dressing electrode (2) for dressing the grindstone and wherein the electrode(2) is oppositely aligned to the grindstone without contact, supplying a conductive grinding fluid between electrode(2) and the grindstone, thereby dressing the grindstone by electrolytic dressing.

According to the disclosed method, the conductive grindstone can be subjected to a high precision profiling process to produce a desired shape by shaping the grindstone with a spark generated at the contact point of the grindstone and the shaping electrode (hereafter, this process is called "spark truing"). In addition, according to the method, the shaped grindstone can be dressed by a voltage that is applied between the grindstone and the dressing electrode oppositely aligned to the conductive grindstone without contact, and conductive grinding fluid is supplied between the electrode and grindstone and the conductive grindstone is subjected to electrolytic dressing to dress the grindstone, and, finally, highly efficient, high quality mirror surface grinding becomes possible.

The present invention provides an apparatus for profile mirror surface grinding comprising: a voltage applying means (9) having a conductive grindstone (1) rotated around its axis and used as a positive electrode, a dressing electrode (2) for dressing, used as a negative electrode and oppositely fixed toward the surface of the grindstone without contact, and a disc-like shaping electrode (4) for shaping as a negative electrode that is rotated around its axis and that is contacted to the surface of the grindstone, a supplying means (10, 11, and 12) for supplying a conductive grinding fluid in a space between the grindstone and the dressing electrode and the shaping electrode, a moving means (20) for moving the disc-like shaping electrode along with the surface of the grindstone, and an actuating means (24) for relatively moving the grindstone to an object (22) to be processed, thereby profile grinding the object and dressing the grindstone simultaneously.

The present invention has achieved grinding processing of a complex and ultra-precise stamping tool used for manufacturing a lead frame for a semiconductor chip. It is because shaping of a grindstone allows reduction of a load in shaping that may be caused by mechanical shaping. In addition it is because the metal bond grindstone containing fine grains is dressed by the ELID grinding method so as to allow simultaneous processing of profiling and mirror surface grinding effectively.

Furthermore, according to the present invention, shaping and dressing of a grindstone can be separately and simultaneously carried out to allow highly efficient setting and dressing of a grindstone with a given shape. On the other hand, sharpness of the grindstone is steadyily maintained by an effect of the ELID grinding and the shape of the grindstone can be maintained, if necessary, in the operation of shaping of the grindstone. Therefore, it becomes possible to reduce the number of steps of grinding for shaping and to shorten the time for scheduling.

According to preferred embodiment of the present invention, the conductive grindstone (1) comprises grains made of diamonds or CBN and a conductive bonding part to fix the grains. This composition allows the spark truing and the ELID grinding to remove effectively the conductive bonding part, and shaping and dressing of the grindstone.

The disc-like electrode (4) comprises a central conductive part and a surrounding semi-conductive part. By this constitution, electric conductivity (electric resistance) of the semi-conductive part can be set to a value appropriate to spark truing.

Besides, the semi-conductive part of the disc-like electrode for shaping preferably contains diamond grains. By this constitution, the combination of spark truing and diamond grains can be applied to grinding.

Other purposes and beneficial characteristics of the present invention will be presented in the following description with reference to drawings.

DESCRIPTION OF THE PREFERRED EMBODIMENT

Herewith, the preferred embodiment of the invention is will be described with reference to the drawings. The same symbol is given to a common part in the respective figures to omit duplicate descriptions.

Figure 1:
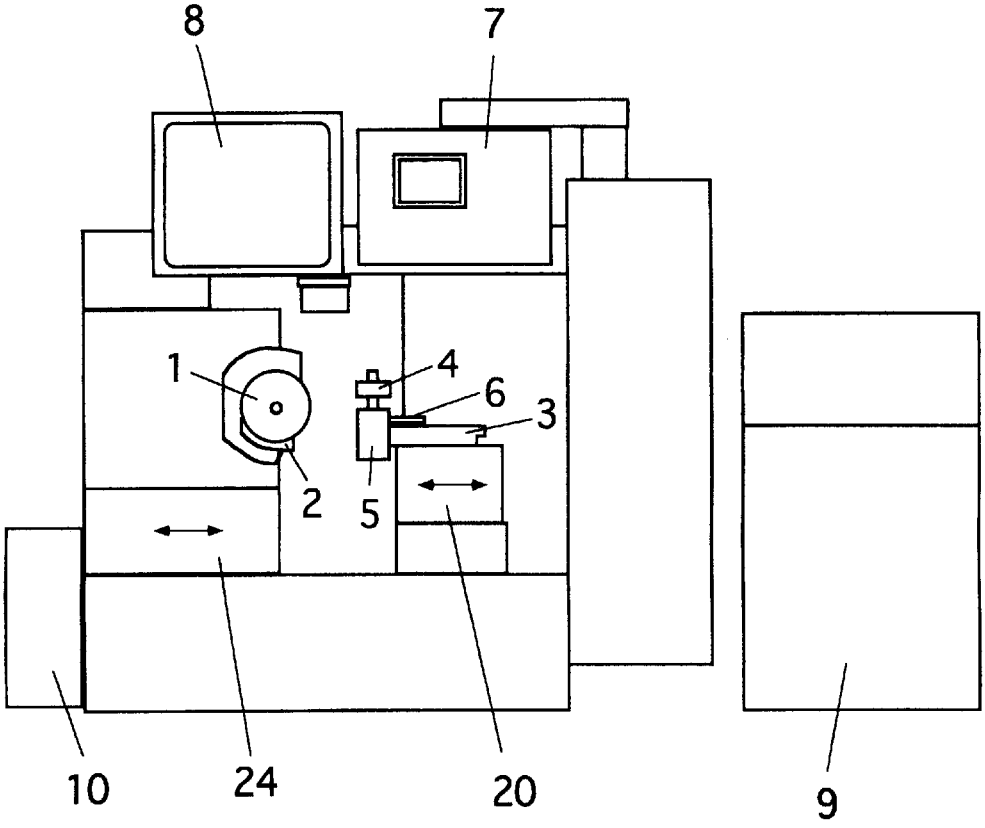
FIG. 1 is a front view of the apparatus for profile mirror surface grinding of the present invention.

FIG. 1 is a front view of the apparatus for profile mirror surface grinding of the present invention. As shown in this figure, the apparatus for profile mirror surface grinding of the present invention has a voltage applying means 9 in which a conductive grindstone 1 is rotated around its axis and is used as a positive electrode, a dressing electrode 2 oppositely fixed to the surface of the grindstone without contact as a negative electrode, a disc-like shaping electrode 4 for shaping as a negative electrode, that is rotated around its axis separately from the conductive grindstone 1, and that is contacted to the surface of the conductive grindstone 1, a supplying means 10, 11, and 12 to supply a conductive grinding fluid in a space between the grindstone 1 and the dressing electrode 2 and the disc-like shaping electrode 4, a moving means 20 to move the disc-like shaping electrode 4 along with the surface of the conductive grindstone 1, and an actuating means 24 to relatively move the grindstone 1 to an object 22 to be processed.

Specifically, in the FIG. 1, a dressing electrode 2 is installed near a conductive grindstone 1 of the apparatus for profile mirror surface grinding in opposing alignment, without contact. On the other hand, a disc-like shaping electrode 4 is installed in a stand 3 for installing an object for processing via a driving means 5. The disc-like is shaping electrode 4 is rotated around its axis separately from the conductive grindstone 1. In addition, the dressing electrode 2 and the disc-like shaping electrode 4 are installed in the main body of the apparatus to have an insulating material 6 such as a plastic board between them in order to insulate electrically from the main body of the apparatus.

Figure 2:
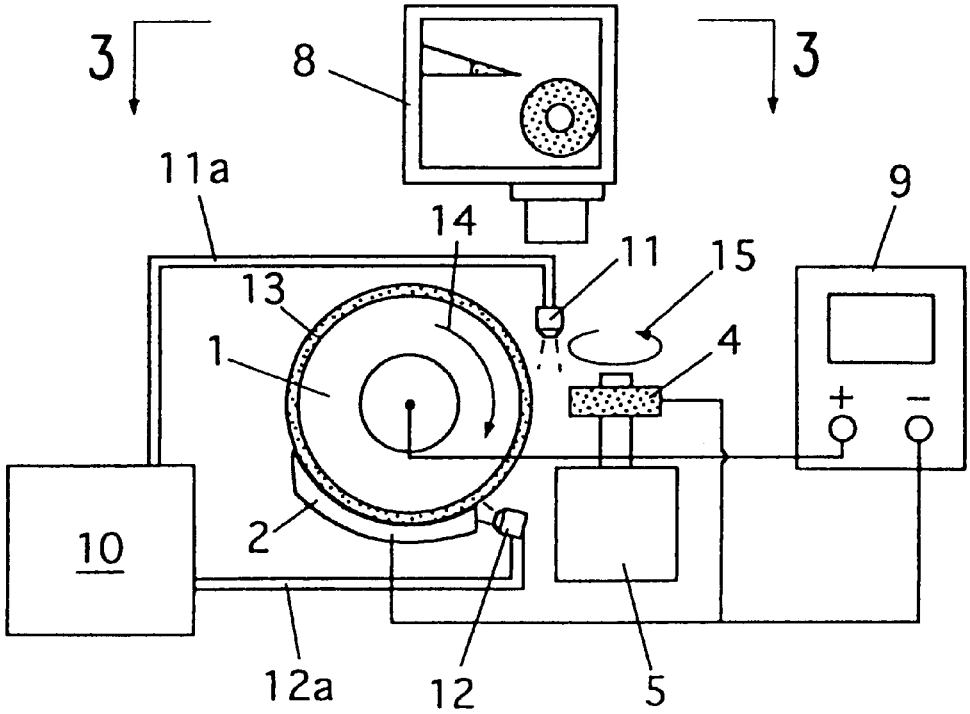
FIG. 2 is a diagrammatic view of the main part of the FIG. 1.
Figure 3:
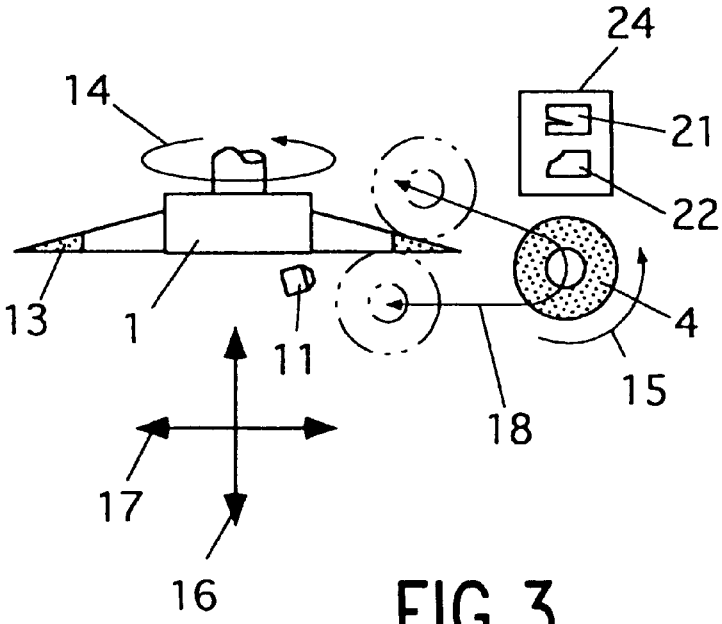
FIG. 3 is a fragmentary view taken in the direction of the arrows substantially along the line A—A.

FIG. 2 is a diagrammatic view of the main part of the FIG. 1, and FIG. 3 is a fragmentary view taken in the direction of the arrows substantially along the line A—A. As shown in the FIG. 2 and FIG. 3, the object 22 to be processed and a thin board 22 for transcribing the shape of the conductive grindstone 1 are installed in the stand 3 for installing an object for processing. In addition, as shown in the FIG. 2, a voltage derived from a power source apparatus 9 as a voltage applying means is applied to make the conductive grindstone 1 be a positive electrode and the disc-like shaping electrode 4 and the dressing electrode 2 be negative electrodes. Furthermore, a supplying apparatus 10 supplying the conductive grinding fluid, nozzles 11 and 12, and a tubing system 11a and 12a passing between them are installed for the conductive grinding fluid as a supplying means to supply the conductive grinding fluid to a space between the grindstone 1 and the dressing electrode 2 and a contact point of the grindstone 1 to the disc-like electrode 4 and a contact point of the grindstone 1 to the object for processing in order to supply the conductive grinding fluid between them.

On the other hand, a projector 8 has been installed in the top of the apparatus to display an image on a screen. Comparative position of the conductive grindstone 1, the object 22 to be processed, and the disc-like shaping electrode 4 are, at any time, monitored by the projector 8. The shape of the grindstone 1 is known by contacting the grindstone 1 to the thin board 21 attached to the stand 3 for installing an object and by transcribing the shape of the grindstone 1 to the thin board 21, in addition to direct monitoring using the projector 8.

The present invention has an actuating means 24 such as X-Y table by NC capable of moving separately and simultaneously the grindstone 1 to the front and back direction 16 and left-hand and right-hand direction 17 of the FIG. 3 according to the designation of a control unit 7 to allow controlling freely the comparative position of the conductive grindstone 1, the object 22, and the disc-like shaping electrode 4 in two dimensions.

According to the constitution of the apparatus for profile mirror surface grinding, as shown in the FIG. 3, the disc-like shaping electrode 4 is comparatively moved according to the surface of the grindstone 1 and the given shape of the grindstone by moving separately and simultaneously the conductive grindstone 1 to the front and back direction 16 and left-hand and right-hand direction 17 on the basis of contacting the grindstone 1 to the disc-like electrode 4, supplying the conductive grinding fluid to the contact point of the conductive grindstone 1 and the disc like shaping electrode 4, and generating a spark. Therefore, the present shaping means of the grindstone can be operated independently and simultaneously with the dressing means of the grindstone by the ELID grinding method and the shaping of shape and dressing of a grindstone can be operated with high efficiency.

According to the present invention, a grindstone is dressed by using the apparatus for profile mirror surface grinding, applying a voltage between the conductive grindstone 1 and the shaping electrode 4, contacting the conductive grindstone 1 to the shaping electrode 4, shaping the conductive grindstone 1 by generating a spark at the contact point, and, simultaneously, applying a voltage between the conductive grindstone 1 and the dressing electrode 2 opposite to the grindstone without contact, supplying the conductive grinding fluid between them, and subjecting the conductive grindstone to electrolytic dressing.

In other words, the conductive grindstone 1 is moved along with the desired shape of the object 22 to be processed, monitoring the comparative position of the conductive grindstone 1 and the object to be processed by the projector 8, by the actuating means 24 capable of moving separately and simultaneously the conductive grindstone 1 to the front and back direction 16 and left-hand and right-hand direction 17. The shaping means of the object to be processed can be operated simultaneously and separately from a means by the ELID grinding method, and is simultaneously applied to profiling process and mirror surface grinding of the object to be processed.

According to aforementioned method, the conductive grindstone 1 can be subjected to a profiling process to produce a desired shape with high precision by contacting the conductive grindstone 1 to the shaping electrode 4 and generating a spark at the contact point to shape the conductive grindstone 1 (spark truing). Furthermore, according to the aforementioned method, the conductive grindstone 1 can be dressed by the ELID grinding between the conductive grindstone 1 and the dressing electrode 2 opposite to the grindstone without contact, and high quality mirror surface grinding can be highly efficiently operated.

An apparatus for profile mirror surface grinding of of the constitution described can achieve grinding processing of a complex and ultra-precise stamping tool that is used for manufacturing a lead frame for a semiconductor chip. This is because shaping of the grindstone allows reducing the load in shaping that may be caused by mechanical shaping. In addition, it is because the metal bond grindstone containing fine grains is dressed by the ELID grinding method so as to allow simultaneous processing of profile mirror surface grinding effectively.

Furthermore, according to the present invention, shaping and dressing of a grindstone can be separately and simultaneously carried out to allow highly efficient setting and dressing of a grindstone with a given shape. On the other hand, sharpness of the grindstone is steadily maintained by an effect of the ELID grinding and the shape of the grindstone can be maintained, if necessary, in operation of shaping of the grindstone. Therefore, it becomes possible to reduce the number of steps of grinding for shaping and to shorten the time for scheduling.

It is preferable that a conductive grindstone (1) comprises grains made of diamonds or CBN and a conductive bonding part to fix the grains. This composition allows the spark truing and ELID grinding to remove effectively the conductive bonding part , and shaping and dressing of the grindstone.

It is preferable that a disc-like electrode 4 comprises a conductive part and a semi-conductive part. By this constitution, electric conductivity (electric resistance) of the semi-conductive part can be set to a value appropriate to spark truing.

Besides, the semi-conductive part of the disc-like shaping electrode 4 preferably contains diamond grains. By this constitution, the combination of spark truing and diamond grains can be applied to grinding.

Embodiments

Next, the present invention will be described in accordance with preferred embodiments.

Figure 4A:
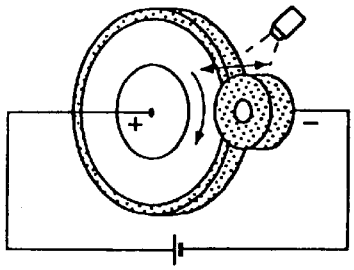
FIG. 4A and B are explanatory figures showing an embodiment of the present invention.

In the first place, spark truing tried by the means that is shown in FIG. 4(A) produced the same stock removal as depth of cut in a very short time. In contrast, a conventional WA grindstone (so-called white alundum grindstone containing a main component of grains made of γ aluminum oxide) as a truing grindstone produced almost no stock removal in comparison with that of the depth of cut. FIG. 3 shows a relationship between depth of cut and reduction in radius. From these results, the conventional WA grindstone is ineffecient and difficult to mechanically true, compared to a very hard grindstone such as a metal bond grindstone made of cast iron used for the ELID grinding.

Figure 4B:
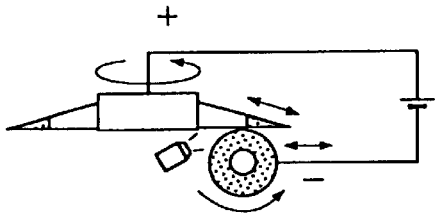
Figure 5:
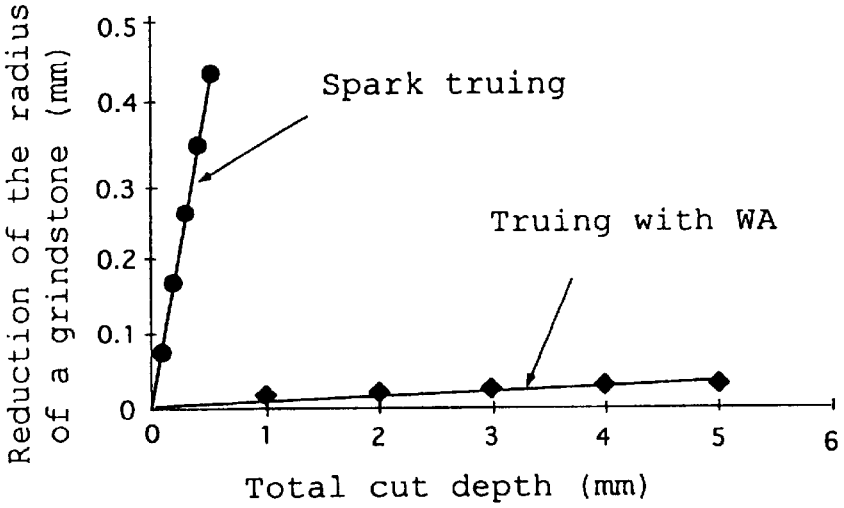
FIG. 5 is a test result of an embodiment of the present invention.

Next, spark truing of a one-side V grindstone (conductive grindstone 1) was carried out by the means shown in FIG. 4(B). The condition of spark truing was applied at a voltage 110 V, a maximum current 10 A, and pulse width in both ON and OFF of 2 μsec. For optimal spark truing, a disc-like electrode (4) for shaping was composed of a conductive part and a semi-conductive part and electric conductivity (electric resistance) of the semi-conductive part was adjusted to a value suitable for spark truing. As a result, the roughness of the grindstone before truing was about 100 μm in the standard surface and about 40 μm in the inclined surface (15°), and, after 3 hours, was reduced to 5 μm.

Figure 6:
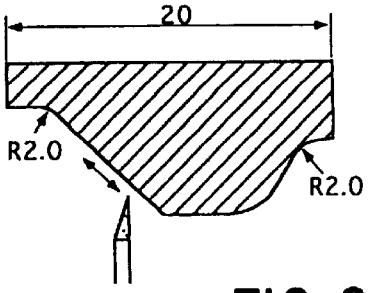
FIG. 6 is another explanatory figure showing an embodiment of the present invention.

A tapered part of the object for processing shown in FIG. 6 was ground by the ELID grinding using the one-side V grindstone (conductive grindstone 1) in combination with spark truing and the roughness of the surface was measured. This object for processing was an ultra-hard alloy (V10 according to JIS), and the roughness of a surface before grinding was 1.31 μmRy. The conditions for the ELID grinding were: an applied voltage of 30 V, a maximum current of 2 A, and pulse width in ON of 2 μsec and OFF of 4 μsec.

As a result, the roughness of the surface after finishing produced was 0.069 μmRa and 0.24 μmRy; very good surface quality was achieved in comparison with the conventional profile-grinding surface.

According to the present invention, when the conductive grindstone was electrically, independently, and simultaneously dressed and shaped, shape and sharpness of the grindstone can be maintained in highly efficient shaping and grinding conditions, and also highly efficient mirror and profiling process, that has so far been difficult, for an object, such as a punch for a lead frame having a complex shape. According to the present invention, a highly precise profiling process has become possible, and, as a result, the punch used for a lead frame having high processing preciseness produces highly precise lead frames. In the case of the punch for a lead frame, a surface subjected to mirror grinding allows improved performance (sharpness, life, etc.) compared with the past.

This means that the method and apparatus for profile mirror surface grinding according to the invention has an excellent effectiveness and is capable of highly efficiently and simultaneously carrying out a highly precise profiling process and high quality mirror surface grinding.

Although the preferred embodiment of the invention has been described, the embodiment is to be considered in all respects as illustrative and not restrictive. In other words, the extent of the present invention includes all improvements, amendments, and equal things included in the range of the claims attached hereto.

What is claimed is:

1. A method for profile mirror surface grinding comprising the steps of:

(A) applying a voltage between a conductive grindstone and a shaping electrode for shaping the grindstone, generating a spark at a contact point by bringing the shaping electrode in electrical contact with the grindstone, thereby shaping the grindstone by the spark, and (B) applying a voltage between the grindstone and a dressing electrode for dressing the grindstone, said dressing electrode being opposed to and aligned with the grindstone without contact, and supplying electrically conductive grinding fluid between the dressing electrode and the grindstone, thereby dressing the grindstone by electrolytic dressing.

2. An apparatus for profile mirror surface grinding comprising:

a voltage supply;

an electrically conductive grindstone rotatable around an axis and arranged to serve as an electrode having a polarity;

a dressing electrode arranged to serve as an electrode having a polarity opposite to that of the grindstone, said dressing electrode being opposed to a surface of the grindstone without contact, and a disc-shaped shaping electrode rotatable around an axis and contactable with the surface of the grindstone, a supply device arranged to supply an electrically conductive grinding fluid to a space between the grindstone and the dressing electrode and a space between the grindstone and the shaping electrode, a moving device arranged to move the disc-shaped shaping electrode along with the surface of the grindstone, and an actuator arranged to relatively move the grindstone to an object to be processed.

3. An apparatus for profile mirror surface grinding according to claim 2, wherein said electrically conductive grindstone comprises grains made of diamonds or CBN and an electrically conductive bonding part fixing the grains.

4. An apparatus for profile mirror surface grinding according to claim 2, wherein said disc-shaped shaping electrode comprises an electrically conductive part and a semi-conductive part.

5. An apparatus for profile mirror surface grinding according to claim 2, wherein said semi-conductive part of the disc-shaped shaping electrode contains diamond grains.

* * * * *